United States Patent [19]

Tatum

[11] Patent Number: 4,838,187

[45] Date of Patent: Jun. 13, 1989

[54] QUILTING MACHINE DEVICE

[76] Inventor: Harold Tatum, 5009 E. Manslick Rd., Louisville, Ky. 40219

[21] Appl. No.: 99,337

[22] Filed: Sep. 18, 1987

[51] Int. Cl.[4] ..... D05B 11/00

[52] U.S. Cl. ..... 112/118

[58] Field of Search ..... 112/118, 119, 86, 90, 112/102

[56] References Cited

U.S. PATENT DOCUMENTS

| | | | |
|---|---|---|---|
| 3,354,850 | 11/1967 | Story | 112/118 |
| 3,559,600 | 2/1971 | Kalning | 112/118 |
| 3,960,095 | 6/1976 | Story | 112/118 |
| 4,006,697 | 2/1977 | Robertson | 112/118 |
| 4,061,096 | 12/1977 | Elsas | 112/118 X |
| 4,651,658 | 3/1987 | Vogel | 112/118 |

*Primary Examiner*—H. Hampton Hunter

*Attorney, Agent, or Firm*—Edward M. Steutermann

[57] ABSTRACT

A quilting method and apparatus for quilting overlying layers of textile material including at least two reel unwind devices to supply at least two webs of the textile of material, a tensioning device to maintain the textile material at a selected tension first and second pairs of nip rollers located in spaced apart generally vertical orientation where the fabric material is fed there between and where a sewing area is defined therebetween, generally horizontally extending sewing machine devices adapted to sew the overlying layers of fabric material together in the sewing area where the nip rollers are carried on a frame means which is capable of moving laterally to the direction of movement of the fabric through the sewing area and where the pairs of nip rollers are rotated in cooperative relation to selectively advance and retract the material in the sewing area so that by proper coordination selected sewn configurations can be provided in the textile material in the sewing area.

4 Claims, 2 Drawing Sheets

QUILTING MACHINE DEVICE

BACKGROUND OF THE INVENTION

The present invention relates in general to quilting machines and more particularly relates to a new and improved quilting apparatus and methods which enable vertical movement of the quilting material during the sewing operation as opposed to horizontal sewing method and apparatus which had previously been utilized.

While other automatic quilting machines and devices are known in the art as for example shown in U.S. Pat. No. 3,960,095 as well as U.S. Pat. Nos. 3,354,850 and 3,559,600 no prior art device is known which provides the advantageous features of devices within the scope of the present invention.

The teaching in U.S. Pat. No. 3,960,095 relates to the use of a quilting frame which is moved universally, that is in for example in X and Y axis for engagement with fixed sewing machines so that the material is sequentially advanced, sewn, and then a new segment of material is again sequentially advanced to be sewn.

No prior art arrangement is known where the material is moved vertically during the sewing operation and fed from a feed device, for example reels of fabric material, in the sewing operation.

In this regard it has been unexpectedly found that several advantages occur in the method and apparatus of the present invention. For example one significant advantage is that in sewing material in a horizontal position where the sewing needle is located above the material the lubricating oil from the needle assembly many times flows onto the material during the sewing operation and during periods where no sewing is occurring and spoil sections of the material.

Additionally, the prior art arrangements which utilize a universally removable frame assembly are unnecessarily complicated in view of the discoveries in accordance with the present invention and greatly add both to the labor, the cost of the equipment as well as maintenance labor required for servicing the equipment because of the complexity of the motion of the device as well as the complexity of the driving mechanism utilized.

In summary, no prior art arrangement is known which provides the features, advantages or the configurations provided by devices within the scope of the present invention.

SUMMARY OF THE INVENTION

The present invention provides a new, useful and particularly advantageous quilting arrangement for quilting overlaying layers of textile material.

Devices within the scope of the present invention provide a particular efficient means of quilting the overlaying layers of textile material in a vertical plane, as opposed to a horizontal plane, to eliminate the problems encountered with prior art arrangements.

Further, devices within the scope of the present invention permit quilting of overlaying textile material without the use of a frame which moves in along two axes to greatly simplify the mechanical complexity of the device needed to perform the quilting operation.

Additionally, devices within the scope of the present invention allow continuous production which results in extremely high rates of production, typically in excess of four times the production rate from currently available technology.

The advantages in accordance with the present invention are accomplished by recognizing the ability of nip roll quilting material to provide movement in one direction while the frame holding the material to be quilted is moved in a direction transverse to the direction of movement of the web through the device.

An additional advantage is provided in that the sewing devices are directed horizontally as opposed to the vertical direction common in prior art arrangements so that bobbin changes can be easily made without the necessity for operator going under the machine. Additionally, devices within the scope of the present invention, with generally horizontally directed sewing needle assemblies, do not encounter the problem of oil drainage onto the material being quilted. Oil flow is easily controlled and oil is maintained in a position away from the material to be quilted.

Various other features also within the scope of the present invention will occur to those skilled in the art upon reading the disclosure set forth hereinafter.

The present invention provides a quilting method and apparatus for quilting overlying layers of textile material including at least two reel unwind devices to supply at least two webs of the textile of material, a tensioning device to maintain the textile material at a selected tension, first and second pairs of nip rollers located in spaced apart generally vertical orientation where the fabric material is fed therebetween and where a sewing area is defined therebetween, generally horizontally extending sewing machine devices adapted to sew the overlying layers of fabric material together in the sewing area where the nip rollers are carried on a frame means which is capable of moving laterally to the direction of movement of the fabric through the sewing are and where the pairs of nip rollers are rotated in cooperative relation to selectively advance and retract the material in the sewing area so that by proper coordination selected sewn configurations can be provided in the sewing area.

While examples within the scope of the present invention are illustrated in the accompanying drawings and described hereinafter but it will be understood that such illustration and descriptions are not by way of limitation but by way of example only and other arrangements also within the scope of the present invention will occur to skilled in the art upon reading the disclosure set forth hereinafter.

BRIEF DESCRIPTION OF THE DRAWINGS

In the example in accordance with the present invention shown in the drawings.

DETAILED DESCRIPTION OF THE DRAWING

Figure 1:
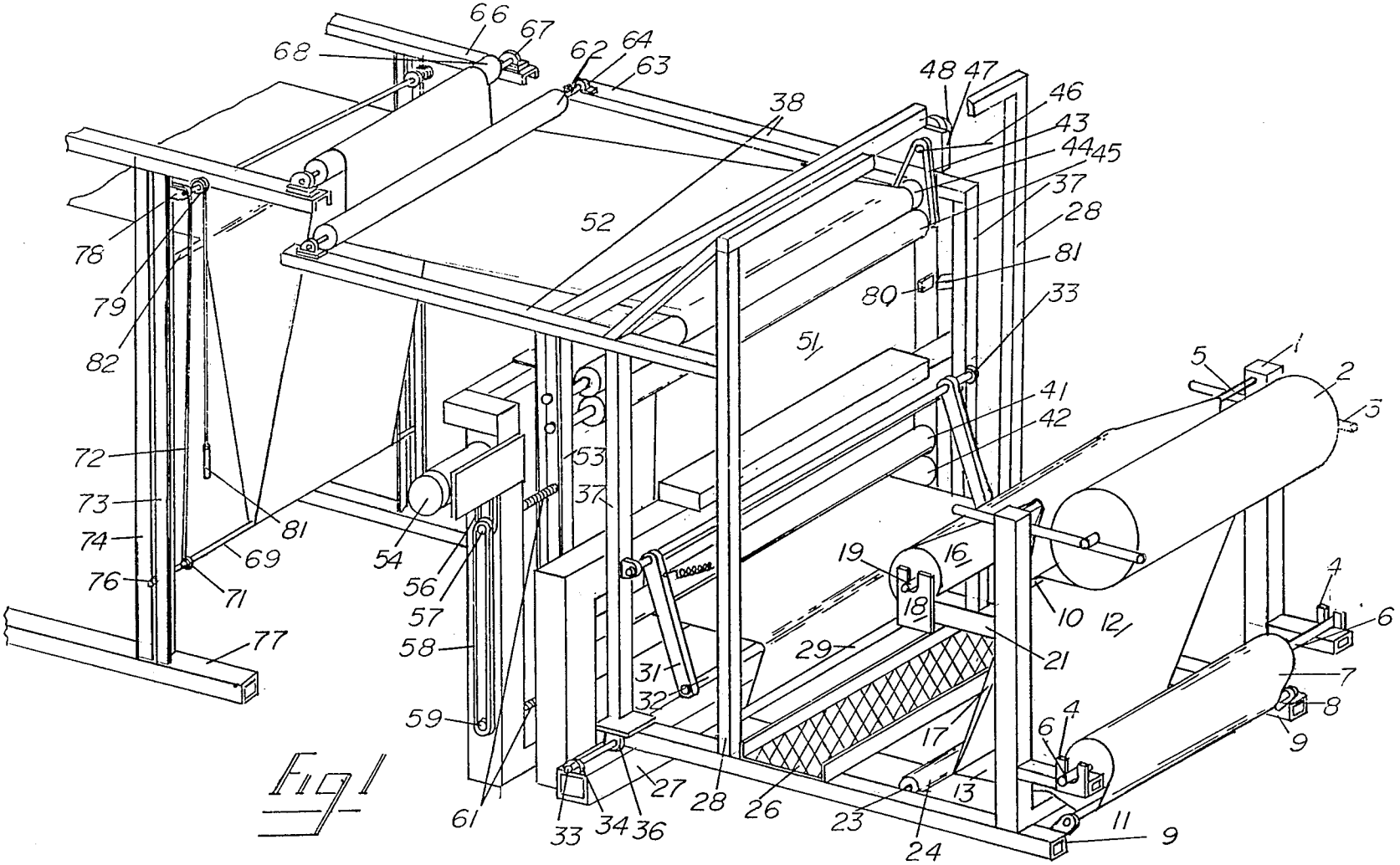
FIG. 1 is a perspective view of an apparatus within the scope of the present invention.

Referring now to FIG. 1 which is an illustration of one example of an arrangement within the scope of the present invention, a base frame member 9 is provided having upstanding "U" channel 1 to hold reels, 2, 7, 16, of material to be quilted in overlaying relation.

In the arrangement shown an arm 21 is provided to extend laterally from the "U" frame 21 having a bracket 18 adapted to receive a spindle 19 of the fabric roll 16. Arms 3 project rearly from the "U" frame 1 and are adapted to receive a reel 1 of material to provide a web 12 of material. Likewise bracket 4 extends rearly from the "U" frame 1 to receive a spindle 6 which holds reel 7 to provide a web 13.

From the Figure it can be seen that reel 16 provides web 17 and that the three webs 12, 13, 17, are collected in overlaying relation on a roller 24 which is journaled by a spindle 23 in the frame 9 as shown.

A tension roll 8 can be provided to maintain tension on roll 7 and the web 12 from the reel 2 passes over an idler 10 while the web 17 passes over an idler 5 to in each case maintain some tension on the webs.

The overlaying layers of material are then passed over an idler roller 29 and beneath a walkway 26 which is provided to allow access to a bobbin case 40 which holds the bobbins for the sewing machine which are located on the opposite side of the web 51 which, as described hereinafter, is the overlaying webs which are quilted in the sewing area between nip roller pairs 41, 42 and 44, 45.

A tensioning arm 31 carring a roller 32 is provided as shown and it is journaled on a shaft 33, as shown, in a frame 37 where a spring 35 maintains tension on the arm 31 to tension the web of material as shown. Nip rollers 41 and 42 are provided to receive the web from the tensioning roller 32 and to provide the upwardly extending web section 51. As shown nip rollers 44 and 45 are provided at the top of the sewing section. The rollers are driven by means of a power source 48 carried by bracket 47 and operated in response to input signals D/B from, for example, a programmable controller comp which controls drive 48 to rotte nip rolls 44, 45 (and nip rolls 41, 42 by chain and sprocket means not shown) to move web 51 back and forth as shown by arrow A. A chain 43 extends around sprockets 46 and sprockets (not shown) carried by the nip rollers to drive the nip rollers.

Figure 2:
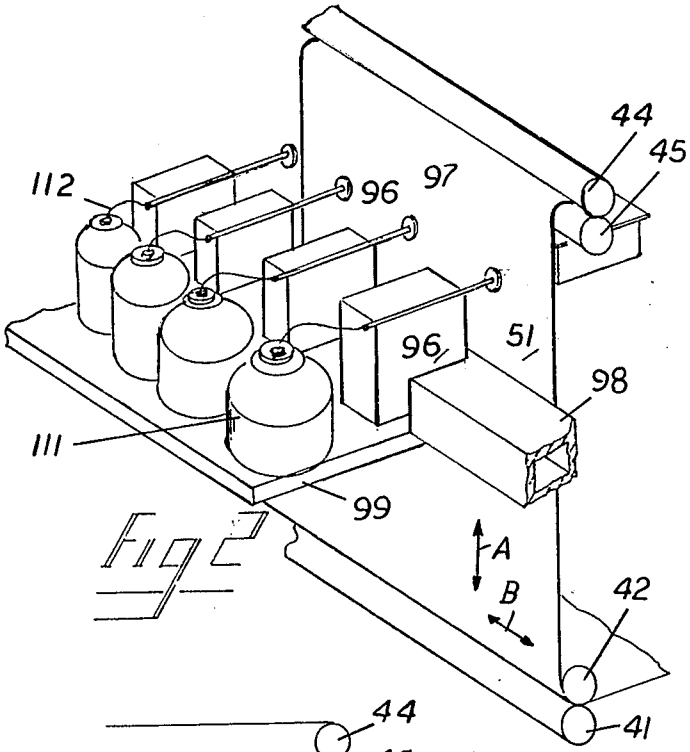
FIG. 2 is a perspective view of a sewing assembly useful in devices in accordance with the present invention which is shown in FIG. 1.

Bobbin enclosure 40 is provided to enclose the bobbins which are located to cooperate with the needle arrangement shown in FIG. 2 which are located on the opposite sides of the web 51.

Sewing of the web 51 occurs in the area shown and the motion necessary for the directional of the device is provided by rotation of the nip rollers 41, 42, 44 and 45. As previously described. Lateral motion of the web is provided by means of a drive 54 which is adapted to drive a chain 56 which drives sprockets 57 and 59 by means of a chain 58 to turn screws 61. The overall assembly is contained in a frame 65 which is adapted to receive a frame 53 in which the nip rollers 41, 42 and 44, 45 are journaled. The frame also carries the drive 48 to provide rotation to and fro rotation for the chain 43 to rotate the nip rollers in order to provide the motion shown by arrow A. Rotation of the screws 61 moves the frame 53 to provide the movement shown by the arrow B so that by proper combination of operation of the drives 54 and 48 various quilting configurations can be provided as the material is passed in front of the fixed sewing needles as described hereinafter.

Figure 3:
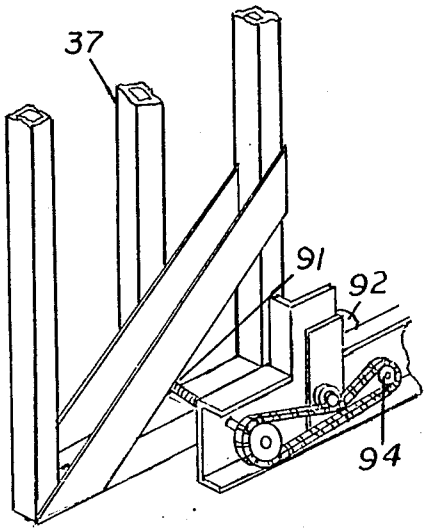
FIG. 3 is a perspective view of a drive assembly for an alignment section of the device shown in FIG. 1.

In order to maintain proper overall alignment of the device an emitter/detector device 81 is provided to direct a beam to a reflective device 80 located on the frame 7. As shown in FIG. 3 the frame member 37 is adapted to be moved back and forth by means of a the screw 91 and where a ball joint is provided in the frame 37 to provide overall alignment of the devices by driving the frame member 37 back and forth with reference to the balance of the assembly. In order to facilitate this movement a shaft 33 is provided as shown in FIG. 1 connected through journals 34 and 36 to allow movement of the frame on the base 27 for alignment in response to signals received from the emitter detector 81 and a reflector 80. Overall control of the device can be achieved by means of a programmable controller comp which is provided to be preprogramed to operate the drives 54 and 48 in a selected pattern to provide the quilting pattern at the section 51.

The controller then operates the drives 48 and 54 to provide the motion shown by the arrows A and B.

After the material has been quilted it is then passed over the outlet nip roller 44 to idler rollers 62, journaled in a journal 64 carried by a frame 63 and over a second tensioning roller 68 carried by a frame 66 and journaled in a journal 67 where the web than travels downwardly and under a bar 69 which is connected by means of a connector 71 to a chain 72 which passes over a shaft assembly 78. A weight 81 is provided at the end of the device to maintain balance against the weight of the bar 69 but yet maintain tension on the web which then passes over roller 82 to a takeup device (not shown).

FIG. 2 is an illustration of an example of a sewing arrangement within the scope of the present invention where machines 96 are provided having the sewing feet 97 located against the web 51. The sewing machines are carried on a bracket 98 which carries a table 99. The sewing machines receive thread from spool enclosures 111 to provide the thread 112 to sewing heads.

The nip rollers 44, 45, as well as nip rollers 41, 42 are shown to hold web in the sewing area and reference movement arrows A & B are likewise shown, showing that the web can move bidirectionally within the sewing area but where the nip rollers only move parallel to the directional arrows B.

Figure 4:
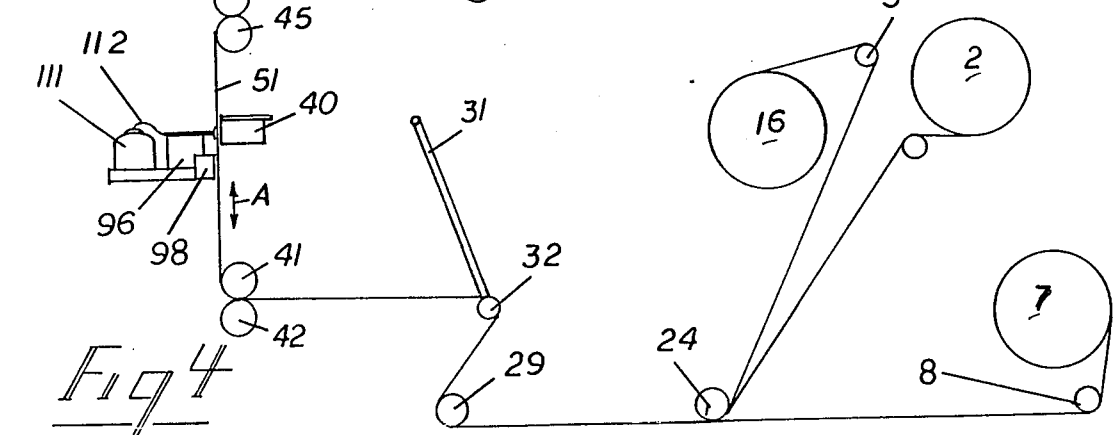
FIG. 4 is a flow chart showing the sequences of operation of the device within the scope of the present invention.

The overall operation is summarized in FIG. 4 where the reels 2, 16, and 7 are shown feeding material passed the roller 23 and then pass the rollers 29, and 32 to the nip rollers 41, 42 where the web 51 passes upwardly to engage sewing machine 96. The web 51 passes in front of the sewing needles 103 as shown for sewing the design in response to movement of the web in the directions A and B.

As previously stated the bobbins are retained in bobbin enclosure 40 and greatly facilitate operation of the device inasmuch as a walkway 26 is provided to allow access to the bobbin enclosure 40 so that the bobbins can be changed quickly during processing.

It will be understood that the foregoing is but one example of an arrangement within the scope of the present invention and that various other arrangements also within the scope of the present invention will occur to skilled in the art upon reading the disclosure set forth hereinbefore.

The invention claimed is:

1. Quilting apparatus for quilting overlying layers of textile material including at least first and second reel unwind devices to supply at least first and second webs of textil material; tensioning device to maintain the first and second webs of textile material at a selected tension; horizontally extending first and second pairs of nip rollers located in spaced apart generally vertical orientation where the said first and second webs of textile material is fed therebetween in overlying relation to provide a sewing area therebetween; generally horizontally extending sewing machine means adapted to sew the first and second overlying layers of textile material together in the sewing area; frame means to carry said first and second overlying layers of textile material together in the sewing area; frame means to carry said first and second pairs of nip rollers which frame means includes adjustment means capable of moving said first and second overlying layers of textile material in said sewing area laterally to the direction of movement of the fabric through the sewing area; drive means to rotate said first and second pairs of nip rollers in cooperative relation to selectively advance and retract the material in the sewing area so that by proper coordination selected sewn configurations can be provided in the first and second overlying layers of textile material in the sewing area.

2. The invention of claim 1 including second tensioning means to receive said at least first and second overlying layers of textile material from said sewing area and hold said overlying first and second layers of textile material in selected tension and takeup means to receive said overlying first and second layers of textile material from said second tensioning means and including reel means to roll up said first and second overlying layers of textile material.

3. The invention of claim 2 wherein said second tensioning means includes weighted roller means located between said sewing area and said takeup means.

4. The invention of claim 1 wherein the needles of said sewing machine means move horizontally.

* * * * *